US010526173B2

(12) United States Patent
Grimaud

(10) Patent No.: US 10,526,173 B2
(45) Date of Patent: Jan. 7, 2020

(54) METHOD FOR SECURING A LIFTING MOVEMENT OF A LOAD AND LIFTING DEVICE ASSOCIATED THERETO

(71) Applicant: Manitowoc Crane Group France, Dardilly (FR)

(72) Inventor: Simon Grimaud, Lyons (FR)

(73) Assignee: Manitowoc Crane Group France, Dardilly (FR)

( * ) Notice: Subject to any disclaimer, the term of this patent is extended or adjusted under 35 U.S.C. 154(b) by 0 days.

(21) Appl. No.: 16/162,033

(22) Filed: Oct. 16, 2018

(65) Prior Publication Data

US 2019/0112163 A1 Apr. 18, 2019

(30) Foreign Application Priority Data

Oct. 16, 2017 (FR) ..... 17 59662

(51) Int. Cl.
*B66C 1/34* (2006.01)

(52) U.S. Cl.
CPC ..... *B66C 1/34* (2013.01); *B66C 2700/08* (2013.01)

(58) Field of Classification Search
CPC ..... B66C 1/34; B66C 13/02; B66C 23/905; B66D 1/485; B66D 1/505; B66D 1/525; B66D 1/58
USPC ..... 340/685
See application file for complete search history.

(56) References Cited

U.S. PATENT DOCUMENTS 4,073,531 A * 2/1978 Androski ..... B66C 1/34 294/75
6,496,765 B1 * 12/2002 Robinett, III ..... B66C 13/063 212/272
7,506,907 B1 * 3/2009 Marler ..... B66C 1/34 294/75
2016/0090277 A1 * 3/2016 Archer ..... B66C 1/422 294/81.61

FOREIGN PATENT DOCUMENTS

EP 2272786 A1 1/2011

OTHER PUBLICATIONS

French Search Report issued by INPI in connection with FR1759662 dated Jun. 5, 2018.

* cited by examiner

*Primary Examiner* — Kerri L McNally
(74) *Attorney, Agent, or Firm* — Levenfeld Pearlstein, LLC

(57) ABSTRACT

A method for securing a lifting movement of a load mechanically coupled to a hook of a lifting device by flexible links, wherein the flexible links can be, when the load is placed on the ground, either in a stretched state or in a relaxed state. The method includes detecting an initiation of a transitional phase between an initial instant when the load is placed on the ground and a final instant when the load is suspended in the air; and emitting a detection signal of a proscribed lifting situation, if the flexible links are, at least at an instant of the transitional phase, in the relaxed state.

13 Claims, 4 Drawing Sheets

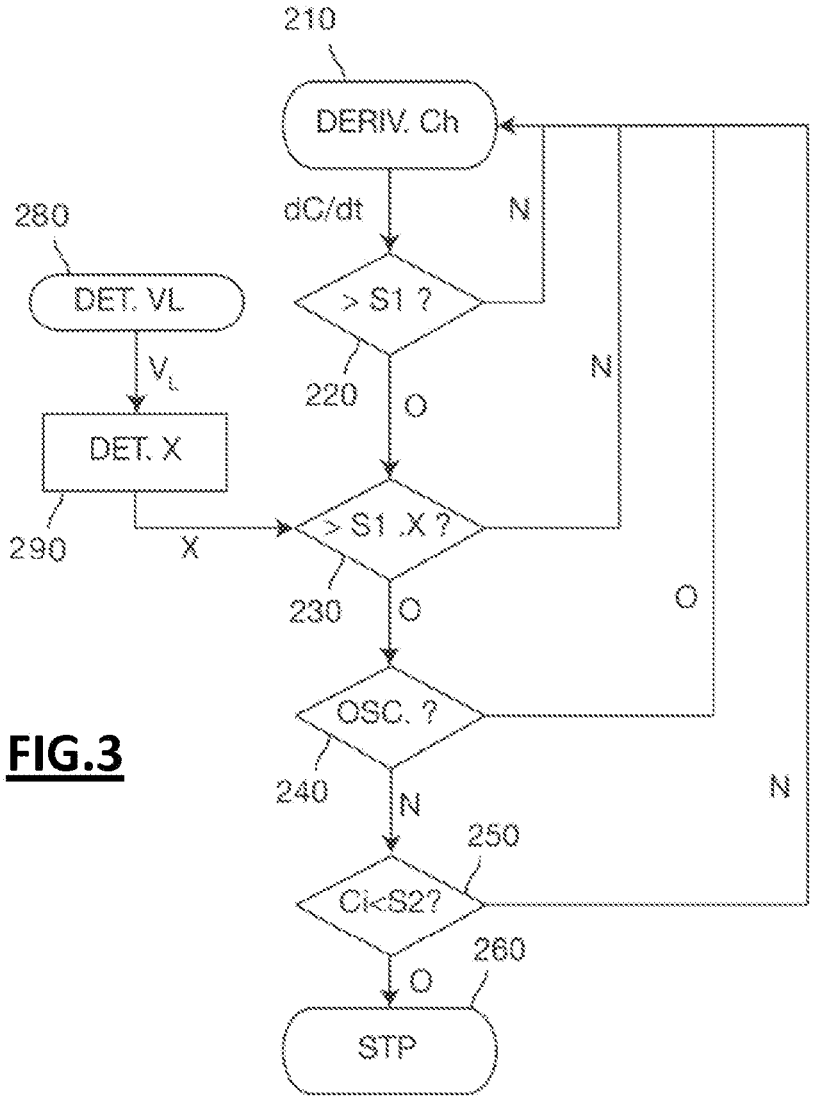
FIG.3
FIG.5a
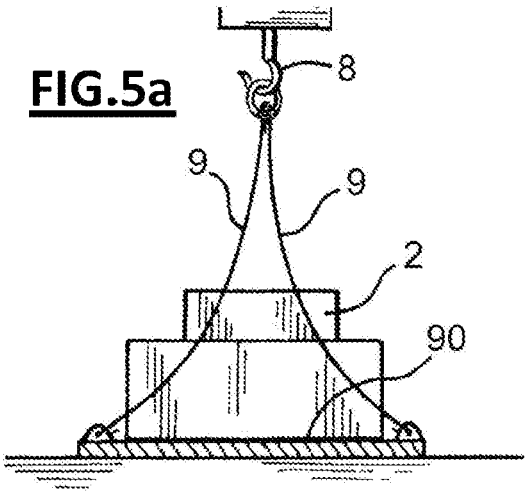
FIG.5b
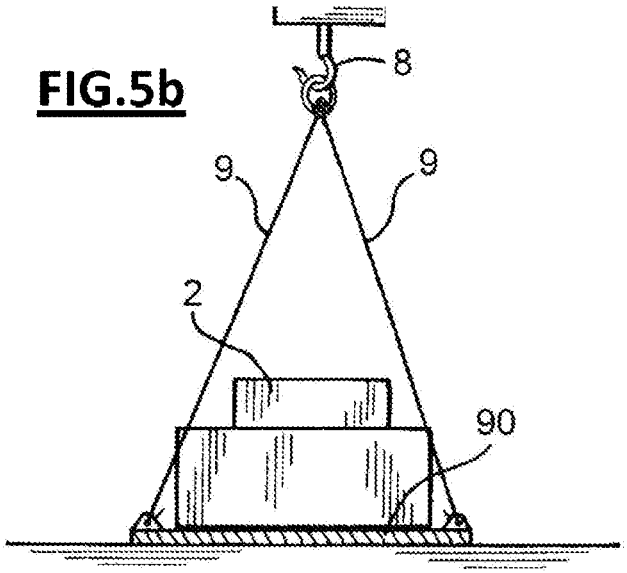

METHOD FOR SECURING A LIFTING MOVEMENT OF A LOAD AND LIFTING DEVICE ASSOCIATED THERETO

CROSS-REFERENCE TO RELATED APPLICATION

This application claims priority under 35 U.S.C. § 119(a) to French Patent Application No. 17/59662, filed on Oct. 16, 2017, the disclosure of which is incorporated by reference herein in its entirety.

FIELD

The present invention relates to the field of the lifting machines, for example, tower cranes, and to the means for securing a lifting movement of a load.

BACKGROUND

According to a conventional configuration, a tower crane comprises a vertical mast, a jib, carried by the mast and azimuth orientable about the mast along a movement called orientation movement, and a carriage which is movably mounted in radial translation along said jib thus performing a movement called distribution movement. The carriage carries a hook, suspended from the carriage by a cable whose length is modifiable by means of a winch that commands thus the vertical movement of said hook, called lifting movement. The load is mechanically coupled to the hook by means of slings.

It is known to provide a crane with an onboard system configured to block/prohibit the execution, by the drive members of the crane, of commands produced according to the instructions of the crane operator that are likely to cause movements considered as inappropriate or which could create undesired results.

The transition phase, during which the load placed on the ground is raised in the air, requires special attention. Thus, in the case of a conventional lifting, the crane operator ensures that the liftoff of the load is carried out at reduced speed. In the event that the value of the measured load exceeds a determined threshold, the system is configured to block the lifting movement before said load leaves the ground. The command control system may further include, as described in the patent document U.S. Pat. No. 8,708,170, means for limiting the oscillations observed during the lifting movement, in particular by detecting the passage of the static state where the load is placed on the ground in the suspended state, and by limiting the speed of the lifting movement during the transition between said states.

However, no known command control system includes means to prohibit the liftoff of the load placed on the ground, if the slings have not been stretched prior to this operation. Indeed, the latter provide that a ground operator attaches the relaxed slings to the load and to the hook of the crane. Then, at low speed, the crane operator performs a lifting movement to stretch the slings, while ensuring however that the load does not lift off from the ground. The ground operator may then verify proper slinging and balancing of the load while on the ground. If the verification proves successful, the crane operator can then start a lifting movement to raise the load in the air. Only once the load is in the air, the crane operator can increase the speed of the lifting movement.

Since the known systems are not configured to detect a sudden lifting of the load attached to the hook with relaxed slings, the load can therefore be raised in the air, although it exceeds the maximum permissible load. Indeed, the speed of the lifting movement being high and the slings being relaxed, it is possible that the measurement of the value of the load can be carried out only once the load is in the air. These manipulations can therefore cause the crane to enter an undesired condition, or damage some components, such as the cable, slings, lifting lug, portion of carriage, portion of block, jib, and other similar components subjected to stress during a lifting operation, That is why there is still a need for means capable of detecting, in order to prohibit them, the movements of lifting in the air a load placed on the ground, if the slings mechanically coupled to the load and to the hook are not stretched.

SUMMARY

One of the objects of the invention is to improve the lifting operations generally of the lifting devices equipped with processing means and with a sensor capable of measuring the value of the load exerted on the hook. Another object of the invention is to reduce the risk of the crane entering an undesired condition or equipment damage, related to a lifting movement, with the slings relaxed.

Another object of the invention is to provide means for improving the lifting operations generally of the lifting devices designed to reduce the risk of mistakenly identifying an undesired lifting condition, typically when the load has already been lifted off.

Another object of the invention is to allow detection of the occurrence of a sudden lifting and to allow prohibiting/blocking the corresponding lifting movement before reaching the maximum load limits of the crane or lifting equipment.

Another object of the invention is to allow a dynamic processing of many parameters relevant for the detection of a lifting movement, with the slings relaxed, said parameters being adaptable to each type of crane.

Another object of the invention is to provide means for improving the lifting operations generally of the lifting devices, inexpensive in terms of required equipment and labor.

Another object of the invention is to provide means for improving lifting operations generally of the lifting devices, reliable over time and robust to failures.

For example, according to a first aspect, the invention relates to a method for securing a lifting movement of a load mechanically coupled to a hook of a lifting device by flexible links, flexible links that can be, when the load is placed on the ground, either in a stretched state or in a relaxed state. The method may include the following steps:

a step of detecting the initiation of a transitional phase between an initial instant when the load is placed on the ground and a final instant when the load is suspended in the air; and a step of emitting a detection signal of a proscribed lifting situation, if the flexible links are, at least at one instant of the transitional phase, in the relaxed state. During the step of emitting a detection signal of a proscribed lifting situation, it is possible to determine whether the flexible links are in the relaxed state by:

determining a value of the load exerted on the hook;

determining the derivative of the value of the load exerted on the hook with respect to time; and identifying that the flexible links are in the relaxed state if the derivative of the value of the load exerted on the hook with respect to time is greater than or equal to a variation threshold.

In one embodiment, instead of the value of the load exerted on the hook, it is also possible to use an equivalent value, for example an equivalent mechanical torque measurement, a current measurement of a lifting motor depending on the value of the load, and/or other measurement values taken at crane components which may change with respect to time at least when the flexible links are in the relaxed state.

During the step of emitting a detection signal of a proscribed lifting situation, it is possible to identify that the flexible links are in the relaxed state, if the derivative of the value of the load exerted on the hook with respect to time is greater than or equal to the variation threshold, during a time sub-period of the transitional phase whose duration is greater than a verification duration. In one embodiment, it is possible to determine the lifting speed of the hook, the verification duration being then determined as a function of the lifting speed so that the verification duration is shorter as the lifting speed of the hook is high.

During the step of detecting the initiation of the transitional phase, it is possible to determine, on an analysis time window, the values of the load exerted on the hook, the initiation of the transitional phase being detected only if no oscillation of the values of the load exerted on the hook, for the analysis time window, is detected. In one embodiment, during the step of detecting the initiation of the transitional phase:

an average, for the analysis time window, of the values of the load exerted on the hook, is determined;

at the end of a waiting period after the analysis time window, the value of the load exerted on the hook is determined;

the initiation of the transitional phase being detected, during the step of detecting the initiation of the transitional phase, only if the difference between, on the one hand, the value of the load exerted on the hook at the end of the waiting period and, on the other hand, the average, for the analysis time window, of the exerted load values, is less than or equal to an oscillation threshold.

When the load is suspended, the dynamics caused by the lifting and distribution movements cause oscillations of the system and disturb the measurement of the load value. These disturbances can create sudden load changes identical to the phenomenon of liftoff, with the slings relaxed. The detection of these oscillations therefore allows distinguishing the cases of liftoff of the load, with the slings relaxed, from the cases of oscillations of the system due to a use, considered as normal, of the lifting device.

During the step of detecting the initiation of the transitional phase, the initiation of the transitional phase being detected, the initiation of the transitional phase is detected only if an initial value of the load exerted on the hook is lower than or equal to a load threshold, this initial value being set at the moment when the derivative of the value of the load exerted on the hook with respect to time is detected as being greater than or equal to the variation threshold.

Thus, it is possible to reduce improper detections, by verifying that the value of the load is relatively low at the moment when the derivative of the value of the load exerted on the hook with respect to time is strong, condition fulfilled when the transitional phase is initiated.

In an advantageous embodiment, the step of emitting a detection signal of a proscribed lifting situation automatically starts a step of cutting the lifting movement of the load.

In a preferred and non-limiting embodiment, the method according to the invention is implemented in a tower crane.

According to a second aspect, the invention relates to a computer program including instructions for performing the steps of the method according to the first aspect, when said program is executed by a processor.

Each of these programs can use any programming language, and be in the form of source code, object code, or intermediate code between source code and object code, such as in a partially compiled form, or in any other desirable form. Particularly, it is possible to use the C/C++ language, the TM language of the scripting languages, such as in particular tcl, javascript, python, perl, which allow a code generation "on demand" and do not require significant overload for their generation or modification.

According to a third aspect, the invention relates to a computer-readable recording medium on which is recorded a computer program comprising instructions for performing the steps of the method according to the first aspect.

The information medium can be any entity or any device capable of storing the program. For example, the medium can include a storage means, such as a ROM, for example a CD-ROM or a microelectronic circuit ROM, or a magnetic recording means, for example a floppy disk or a hard disk. On the other hand, the information medium may be a transmissible medium such as an electrical or optical signal, that can be conveyed by an electrical or optical cable, by radio or by other means. The program according to the invention can be downloaded particularly on an Internet or Intranet network. Alternatively, the information medium can be an integrated circuit in which the program is incorporated, the circuit being adapted to execute or to be used in the execution of the method in question.

According to a fourth aspect, the invention also relates to a module, adapted to implement the method according to the first aspect, for securing a lifting movement of a load mechanically coupled to a hook of a lifting device by flexible links, flexible links that can be, when the load is placed on the ground, either in a stretched state or in a relaxed state. The module includes:

means for detecting the initiation of a transitional phase between an initial instant when the load is placed on the ground and a final instant when the load is suspended in the air; and means for emitting a detection signal of a proscribed lifting situation, if the flexible links are, at least at one instant of the transitional phase, in the relaxed state.

In one embodiment, the means for emitting a detection signal of a proscribed lifting situation can be configured to determine whether the flexible links are in the relaxed state by:

determining a value of the load exerted on the hook;

determining the derivative of the value of the load exerted on the hook with respect to time; and identifying that the flexible links are in the relaxed state if the derivative of the value of the load exerted on the hook with respect to time is greater than or equal to a variation threshold.

According to a fifth aspect, the invention also relates to a lifting device including a security module according to the fourth aspect, such as for example a tower crane.

The invention can also be applied to other families of cranes, such as a luffing jib crane, etc., by transposing the calculations made according to the model of the invention to the geometry of said cranes.

BRIEF DESCRIPTION OF THE DRAWINGS

Other features and advantages of the present invention will become apparent, from the following description of embodiments, with reference to the accompanying drawings, in which:

FIG. 3 is a block diagram of the steps of a method for securing a lifting movement of a load, according to an embodiment;

FIG. 5*a* shows schematically the load placed on the ground surrounded by relaxed slings attached to the hook;

FIG. 5*b* shows schematically the load placed on the ground surrounded by stretched slings attached to the hook;

DESCRIPTION

Figure 1:
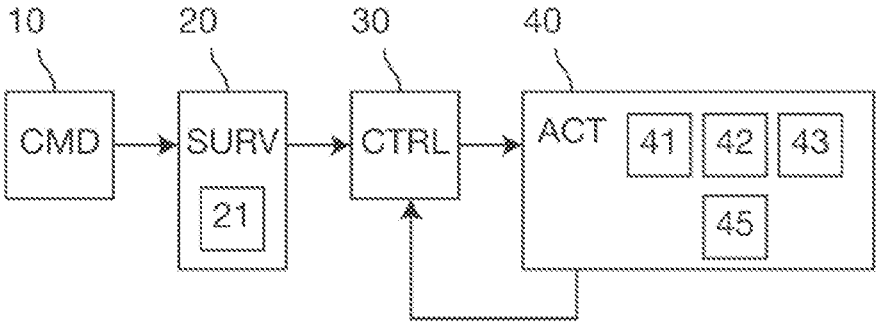
FIG. 1 is an architecture diagram of a system for controlling the lifting of a load, according to one embodiment.

FIG. 1 shows a system 1 for controlling the lifting of a load 2 according to an embodiment. This system 1 is applicable to a load lifting device such as a tower crane 3.

Figure 4:
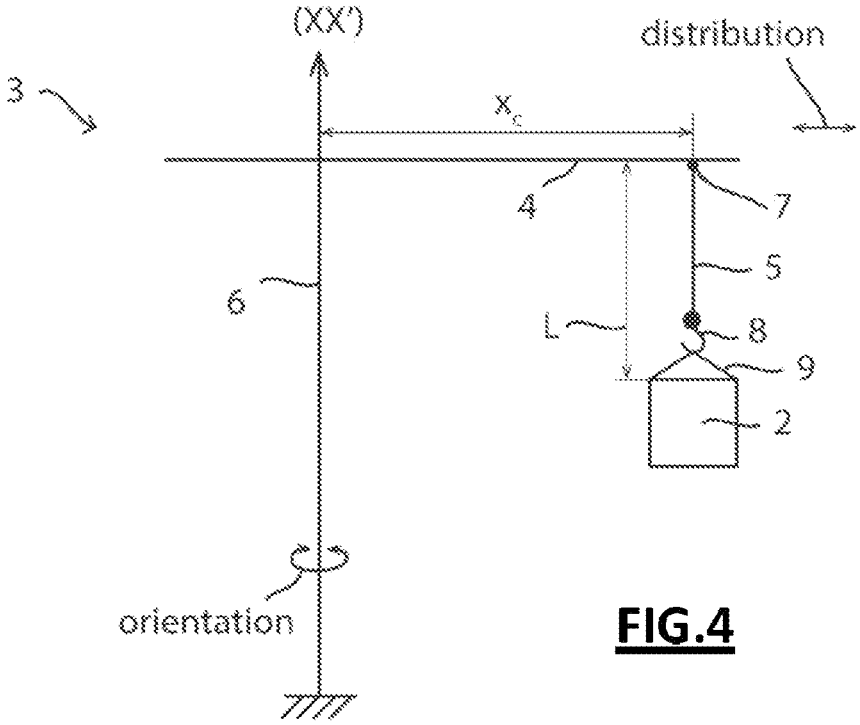
FIG. 4 is a schematic representation of a tower crane, according to an embodiment.

With reference to FIG. 4, it can be considered to apply the system 1 to any type of crane 3 comprising a jib 4 which is yaw orientable about a vertical axis (ZZ'), according to an orientation movement, and which is arranged so that the load 2 is suspended from said jib 4 by means of flexible links 9 (or slings) coupled to a hook 8 carried by a cable 5, and this in such a way that said crane 3 can modify the radial distance of said load 2 with respect to the vertical axis, according to a distribution movement, as well as the length of the cable 5 that connects the jib 4 to the load 2, according to a movement called lifting movement, in order to be able to modify the altitude of the load 2.

The crane 3 can thus form for example a luffing jib crane (tilting jib), a telescopic crane or, in one embodiment, a tower crane.

The flexible links 9, known as slings, are flexible lifting accessories, typically made from ropes, cables and/or chains, provided at their ends with attachment devices—such as hooks, shackles or lifting rings—intended to be coupled to the hook 8 of the crane.

Once positioned, the flexible links 9 are attached to the load, in order to allow the crane to move said load. The flexible links 9 can also include other attachment elements—for example shackles—so as to allow their mechanical coupling to the load.

In the following non-limiting example, the tower crane comprises a vertical mast 6, which materializes the vertical axis (ZZ'), a jib 4 carried by the mast 6 and azimuth (yaw) orientable about the mast 6, and a carriage 7 that is movably mounted in radial translation along said jib.

In the following examples, for convenience of description, the means for mechanically coupling the load 2 to the hook 8 of the crane will be assimilated to slings 9 forming, as a reminder, flexible links.

The secure procedure is now described according to the state of the art for driving the load 2 in a lifting movement from the ground up to the air, with reference to FIGS. 5*a* and 5*b* in which the load 2 placed on the ground is represented, in a static state.

At first, shown in FIG. 5*a*, the slings 9 are secured to the load 2: typically, a ground operator surrounds the load 2 with the slings 9 and attaches them to the hook 8 of the crane. Alternatively, the slings 9 can be attached to a platform 90 on which the load 2 is placed. In order to perform this operation, the slings 9 must be relaxed.

Then, in a second step, the crane operator starts a lifting movement of the hook 8, at low speed, so as to stretch the slings, as shown in FIG. 5*b*. The load remains in the static state, placed on the ground and must not leave the ground. The ground operator then confirms proper slinging and balancing of the load remained on the ground. Upon confirmation by the ground operator, the crane operator proceeds to a new lifting movement, the slings being previously stretched, this time driving the load 2 in the air. The load 2 is then in a suspended state (not shown in the figures).

The transition from the static state to the suspended state of the load 2 must necessarily, for safety reasons, be carried out only when the slings are stretched.

Figure 6A:
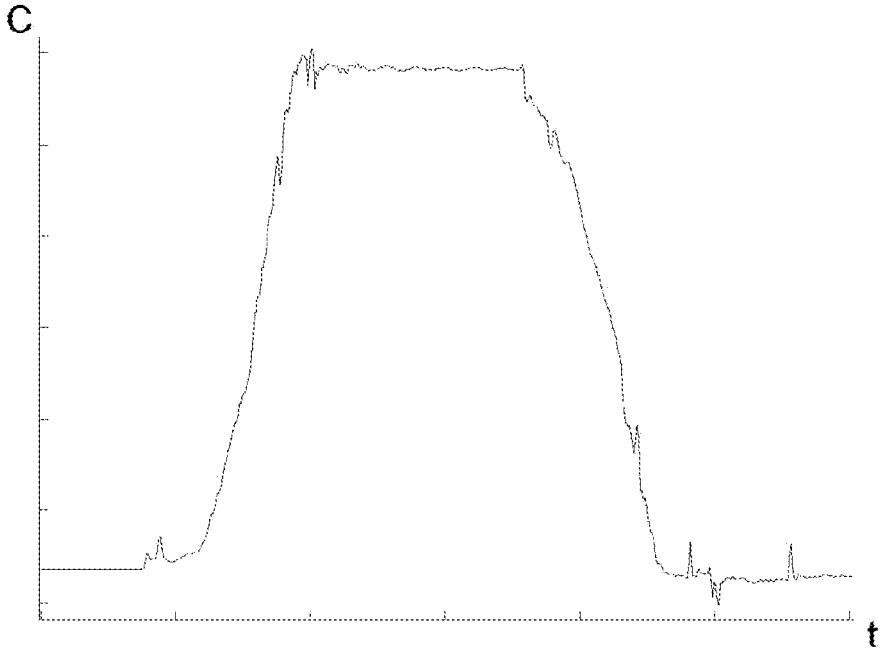
FIG. 6*a* is a diagram showing the variation over time t of the value C of the load exerted on the hook, when the lifting movement has been performed while the slings were stretched, at reduced speed.
Figure 6B:
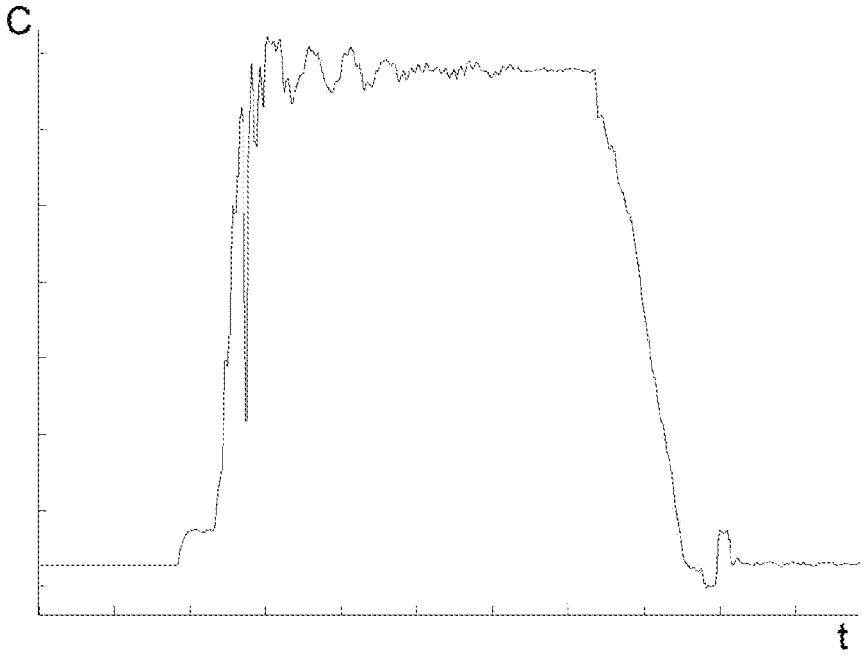
FIG. 6*b* is a diagram showing the variation over time t of the value C of the load exerted on the hook, when the lifting movement has been performed while the slings were relaxed.

FIG. 6*a* shows, on a diagram, the variation over time of the value C of the load exerted on the hook 8, when the lifting movement has been carried out while the slings were stretched, at reduced speed. In contrast, FIG. 6*b* shows, on a diagram, the variation over time of the value C of the load exerted on the hook 8, when the lifting movement has been carried out while the slings were relaxed, unlike to what is provided by the secure procedure. It is particularly found that the variation over time of the value C of the load is much greater than in the example of FIG. 6*a*.

The command control system 1, according to embodiments described herein, includes particularly a pilot device 10, a monitoring and control device 20, a controller 30, and a command execution system 40.

The command execution system 40 may include:

a lifting drive device 41 coupled to the winch, able to move the load 2 according to a lifting movement, depending on the received instructions;

a distribution drive device 42 coupled to the carriage 7, able to move said carriage 7 according to a distribution movement, depending on the received instructions;

an orientation drive device 43 coupled to the jib 4, able to move said jib, and therefore the carriage 7 and the load 2 according to an orientation movement, depending on the received instructions.

The command execution system 40 also includes a measuring system 45 configured to deliver a set of physical and mechanical measurements MES, related to the drive devices 41-42-43, to the load, as well as to the environment of the crane 3.

In one embodiment, the measuring system 45 includes a set of sensors for measuring the value of the vertical load produced by the load 2.

The pilot device 10 is configured to produce CMD lifting speed instructions depending on interactions with a crane operator and to transmit said CMD lifting speed instructions to the monitoring and control device 20. The lifting speed instructions CMD may include in particular positioning and/or speed and/or acceleration instructions intended particularly to be transmitted to the lifting drive device 41.

The pilot device 10 generally comprises a user interface, for example of the joystick kind, that is intended to be handled by a crane operator in order to produce the lifting speed instructions CMD. However, the lifting speed instructions CMD can also be produced by other means, such as an automated pilot device.

The monitoring and control device 20 is coupled to the pilot device 10 in order to receive the lifting speed instructions CMD and to the system for measuring the command execution system 40 in order to receive the set of measurements MES.

The monitoring and control device 20 is configured to produce, depending on the lifting speed instructions CMD and on the set of measurements MES, optimized lifting speed instructions CMD' intended to be executed by the lifting drive device 41 in order to move the suspended load 2 according to a lifting movement, within the limits of the crane. According to the invention, the monitoring and control device 20 further includes a security module 21 configured to identify the proscribed lifting situations, considered as abnormal and/or capable of placing the crane in an undesired condition and/or prohibited. The monitoring and control device 20 is further configured to prohibit the implementation of the lifting speed instructions CMD when the security module 21 has identified a proscribed lifting situation, and/or to produce an alert signal intended to a control device operably connected to one or more crane components and configured to control operation(s) of the one or more crane components to block the lifting movement and/or put the crane in a secure configuration. In one embodiment, such a control device (or devices) may be, for example, the monitoring and control device 20 and/or the controller 30, one or more devices integrated therewith, and/or one or more devices separate therefrom. The one or more crane components may include, for example, the lifting drive device 41, the distribution drive device 42 and/or the orientation drive device 43.

The controller 30 is coupled to the command execution system 40 and to the monitoring and control device 20 in order to receive the optimized lifting speed instructions CMD'.

The controller 30 is configured to control the lifting drive device 41 belonging to the control execution system 40, depending on the optimized lifting speed instructions CMD'.

Typically, the controller 30 includes automated control means, for example in a closed loop, in order to control, depending on the information transmitted by the sensors of the measuring system and on the information comprised in the optimized lifting speed instructions CMD', the positioning, the speed and/or the acceleration of the mechanical members of the command execution system 40.

Figure 2:
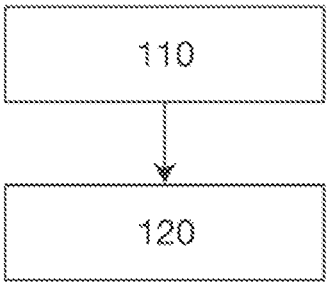
FIG. 2 is a block diagram of the steps of a method for securing a lifting movement of a load according to an embodiment.

Referring to FIG. 2 which shows a block diagram of the steps of a method, according to the invention, for securing a lifting movement of a load 2 mechanically coupled to a hook 8 of a lifting device by flexible links 9. According to one embodiment the method may be implemented by the security module 21 of the monitoring and control device 20.

The flexible links 9 can be, when the load is placed on the ground, either in a stretched state (as shown in FIG. 5*b*) or in a relaxed state (as shown in FIG. 5*a*). The flexible links 9 are for example slings. In the case where the lifting device is a tower crane, the hook 8 is suspended from a jib 4 carried by a mast of a crane. The flexible links 9 are particularly in the relaxed state in order to allow their mechanical coupling to the load 2 and to the hook 8. The flexible links 9 are in particular in the stretched state, when a ground operator performs the required security checks before the lifting of the load in the air, and when the load is in the air.

The method includes a step 110 of detecting the initialization of a transitional phase between an initial instant when the load is placed on the ground and a final instant when the load is suspended in the air.

The method includes a step 120 of emitting a detection signal of a proscribed lifting situation, if the flexible links 9 are, at least at one instant of the transitional phase, in the relaxed state.

The detection signal is for example transmitted to the monitoring and control device 20 so that the latter can prohibit the implementation of lifting speed instructions likely to aggravate the situation. The detection signal may also be transmitted to one or more of the control device(s) operably connected to the one or more crane components and configured to control operation(s) of the one or more crane components to block the lifting movement and/or to put the crane in a secure configuration.

The method thus allows detecting the occurrence of a sudden lifting and cutting the movements before having reached the maximum limits of damage or which would place the lifting equipment in an undesired condition.

Referring now to FIG. 3, an embodiment of the method for securing the lifting movement of the load is shown.

In order to determine whether the flexible links 9 are in the relaxed state, a value C of the load exerted on the hook 8 is determined, during a step 210, and then the derivative DERIV.CH of said value C is calculated with respect to time, in other words:

$$DERIV \cdot CH = \frac{dC}{dt}$$

During a step 220, the derivative DERIV.CH is then compared with a variation threshold S1.

By way of non-limiting example, the variation threshold S1 corresponds to a percentage of the maximum load admissible at the current reach, where this percentage is for example comprised between 1 and 5%, and in particular in the order of 2 to 4%.

If the derivative DERIV.CH is greater than or equal to the variation threshold S1, then the flexible links 9 are identified as being in a relaxed state; otherwise the flexible links 9 are identified as being in a stretched state.

According to one embodiment, to improve the robustness as to the detection of the phenomenon and to limit the risks of false detections due to disturbances on the measurement of the value C, it is possible to identify, in another step 230, that the flexible links 9 are in the relaxed state, if the derivative DERIV.CH is greater than or equal to the variation threshold S1, during a time sub-period SPT of the transitional phase whose duration is greater than or equal to a verification duration X. By way of non-limiting example, such a verification duration X may be comprised between 100 and 600 ms, and in one embodiment, between 150 and 300 ms according to the crane.

Figure 7A:
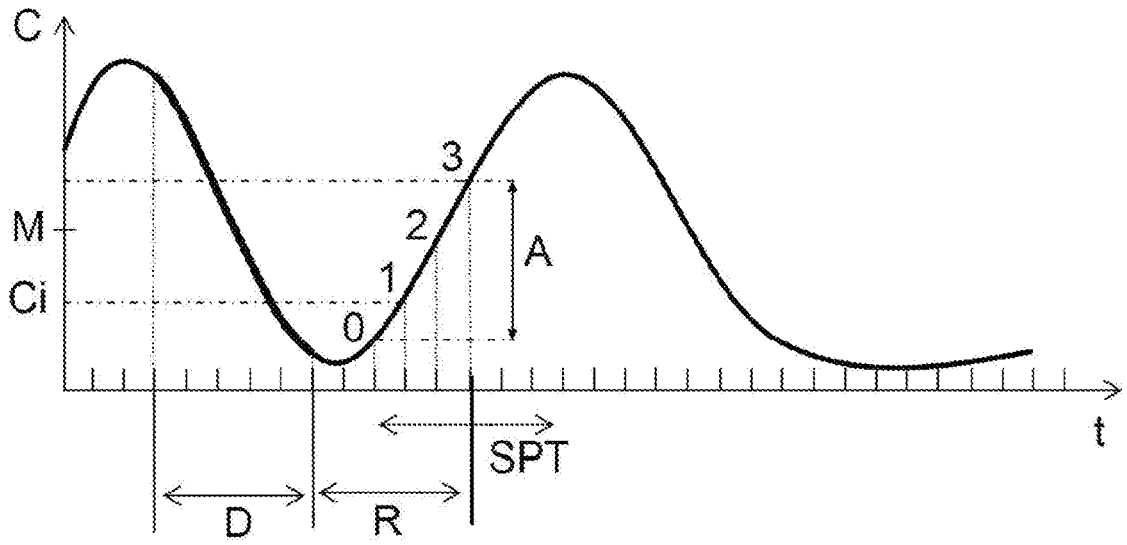
FIG. 7*a* is a diagram showing a signal of variation of the load value C over time t, corresponding to a case where the load is suspended in the air and oscillates.
Figure 7B:
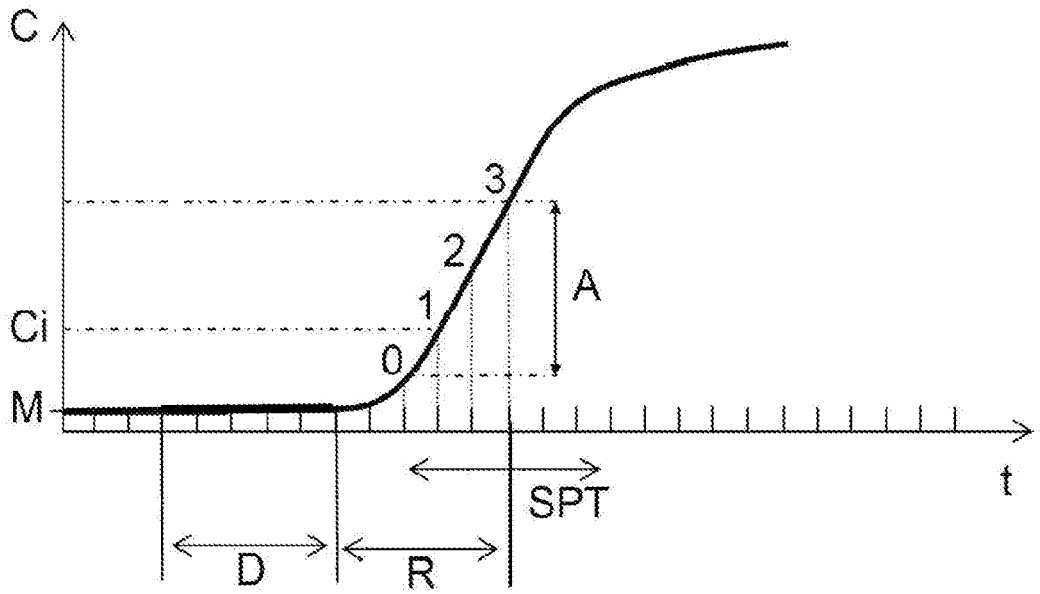
FIG. 7*b* is a diagram representing a signal of variation of the load value C over time t, corresponding to a case where the load is placed on the ground before being suspended in the air.

For example, if, during the step 220, the derivative DERIV.CH is greater than or equal to the variation threshold S1, a timer can be started, the measurement of the value C being periodically updated. In FIGS. 7*a* and 7*b*, the starting of the timer is illustrated by the point "0", and the following points "1, 2, 3, . . . " illustrate the periodic instants of measurement of the value C of the load.

The timer is stopped only when the derivative DERIV.CH becomes again lower than the variation threshold S1, and/or when the elapsed time is at least equal to the verification duration X.

If the time sub-period SPT thus measured by the timer is greater than or equal to the verification duration X, then it can be identified in step 230 that the flexible links 9 are in the relaxed state. However, if the derivative DERIV.CH is less than the variation threshold S1 for a duration less than the verification duration X, then the flexible links 9 are identified as being in a stretched state.

In one embodiment, the verification duration X is determined, during a step 290, as a function of the lifting speed VL of the hook, obtained during a step 280 so that the verification duration X is shorter as the lifting speed VL of the hook is high. It is therefore possible to adapt the reactivity of the method by increasing or decreasing the time necessary to identify that the flexible links 9 are in the relaxed state.

Thus, if the lifting speed VL is high, it is advantageous to react rapidly, typically by taking, as a verification duration X, a duration in the order of 150 ms. If the lifting speed is relatively low, the detection reliability can be preferred and the reaction time reduced, typically by taking, as a verification duration X, a duration in the order of 300 ms. By way of illustrative and non-limiting example, a low lifting speed VL corresponds to a speed that is lower than an intermediate speed VIN, and a high lifting speed VL corresponds to a speed that is greater than this intermediate speed VIN while remaining less than a maximum authorized speed VMA, where for example the intermediate speed VIN is comprised between 0.1 and 0.3 m/s, and where for example the maximum authorized speed VMA is in the order of 1 to 1.5 m/s.

During a step 240, that follows the step 230, the values C of the load exerted on the hook are determined on an analysis time window, the initiation of the transitional phase being detected only if no oscillation of the values of the load exerted on the hook, for the analysis time window, is detected.

In FIG. 7*a*, a diagram shows the change in the value of the load C exerted on the hook over time, corresponding to a case where the load is suspended in the air and oscillates. In FIG. 7*b*, a diagram showing the change in the value of the load exerted on the hook over time, corresponding to a case where the load is placed on the ground and then raised in the air.

In order to detect an oscillation, it is possible to determine an average M, for the analysis time window of a duration D, of the values C of the load exerted on the hook.

Then, at the end of a waiting period R after the analysis time window, it is possible to determine the value C of the load exerted on the hook. The initiation of the transitional phase is then detected, only if the difference ΔCM is less than or equal to an oscillation threshold A, where the difference ΔCM corresponds to the difference between, on the one hand, the value C of the load exerted on the hook at the end of the waiting period and, on the other hand, the average M, for the analysis time window, of the exerted load values, namely:

$$\Delta CM = C - M.$$

This oscillation threshold A can be established depending on:

the mass of the load 2 lifted;

the reach at which the load 2 is lifted on the jib 4 (this reach corresponding to the distance Xc in FIG. 4);

the lifting speed VL.

For example, for a given crane model, the oscillation threshold A can vary between 9% and 75% of the maximum load authorized at the current reach. Thus, in the example of FIG. 7*a*, the condition ΔCM≥A is not fulfilled, reflecting a detection of an oscillation, which corresponds to the load suspended in the air and oscillating. On the other hand, in the example of FIG. 7*b*, the condition ΔCM≥A is well fulfilled, reflecting an absence of oscillation and therefore a case of sudden lifting of the load.

In order to determine whether the load is placed on the ground, during a step 250, an initial value Ci of the load exerted on the hook is determined (see FIGS. 7*a* and 7*b*) at the moment when the timer is started or at the next instant "1", in other words as soon as the derivative DERIV.CH is detected as being greater than or equal to the variation threshold S1.

If the initial value Ci of the load exerted on the hook is less than or equal to a load threshold S2, then the load is identified as being placed on the ground. Indeed, the initial load value Ci is quite low during the initiation of the transitional phase, prior to the liftoff of the load. Thus, the method allows identifying effectively the situations in which the load lifts off, and not those where said load is already in the air, which thereby allows reaching a final step 260 in which it is confirmed that the load was on the ground and has lifted off with the slings 9 stretched.

According to embodiments described herein, the system 1 for controlling the lifting of the load 2 may include, for example, a computer having a processor and a computer-readable recording medium operably connected to the processor. The computer-readable recording medium is configured to store program instructions, which when executed by the processor, cause the system 1 to perform the methods described herein. In one embodiment, the computer may be integrated with the monitoring and control device 20.

In one embodiment, as described above, a detection signal of a proscribed lifting situation may be emitted. In response to receiving such a signal, the system 1, for example, the monitoring and control device 20 or the controller 30 may control operations of one or more crane components, such as the lifting drive device 41, the distribution drive device 42 and/or the orientation drive device 43. For example, the lifting drive device 41 may be controlled to stop a lifting operation or to change the speed of the lifting operation.

In one embodiment, the monitoring and control device 20 include the security module 21. The security module 21 may be configured to detect an initiation of the transitional phase based on, for example, values of the vertical load measured by and received from measuring system 45, and one or more time periods or windows. As detailed in the embodiments above, the initiation of the transitional phase may be detected, for example, if the difference between the value of the load exerted on the hook at the end of the waiting period and the average for the analysis time window, of the exerted load values, is less than or equal to an oscillation threshold. In one embodiment, this difference may be determined by the aforementioned computer, or a different computer substantially similar to the aforementioned computer. The security module 21 may also include a transmitter configured to emit the detection signal of a proscribed lifting situation in the manner detailed above. The emitted detection signal may be received, for example, by the monitoring and control device 20, the controller 30 and/or the command execution system 40. In one embodiment, the computer may be integrated in or operably connected to the security module 21.

Further, it is understood that in the embodiments described herein, various information, such as the threshold values, other predetermined information, or information determined during execution of the methods described herein, may be stored in a memory, such as the computer-readable recording medium.

The invention claimed is:

1. A method for securing a lifting movement of a load mechanically coupled to a hook of a lifting device by flexible links, wherein the flexible links, when the load is placed on the ground, are either in a stretched state or in a relaxed state, the method comprising:

detecting an initiation of a transitional phase between an initial instant when the load is placed on the ground and a final instant when the load is suspended in the air; and emitting a detection signal of a proscribed lifting situation, if the flexible links are, at least at one instant of the transitional phase, in the relaxed state.

2. The method according to claim 1, wherein, during emitting a detection signal of a proscribed lifting situation, it is determined whether the flexible links are in the relaxed state by:

determining a value (C) of the load exerted on the hook;

determining the derivative (DERIV.CH) of the value (C) of the load exerted on the hook with respect to time;

identifying that the flexible links are in the relaxed state if the derivative (DERIV.CH) of the value (C) of the load exerted on the hook with respect to time is greater than or equal to at a variation threshold.

3. The method according to claim 2, wherein, during emitting a detection signal of a proscribed lifting situation, it is identified that the flexible links are located in the relaxed state, if the derivative (DERIV.CH) of the value (C) of the load exerted on the hook with respect to time is greater than or equal to the variation threshold during a time subperiod (SPT) of the transitional phase whose duration is greater than a verification duration (X).

4. The method according to claim 3, wherein a lifting speed (VL) of the hook is determined, the verification duration (X) being then determined depending on the lifting speed (VL) so that the verification duration (X) decreases as the lifting speed (VL) of the hook increases.

5. The method according to claim 1, wherein, during the detection of the initiation of the transitional phase, the values (C) of the load exerted on the hook are determined on an analysis time window of a predefined period (D), the initiation of the transitional phase being detected only if no oscillation of the values (C) of the load exerted on the hook, for the analysis time window, is detected.

6. The method of claim 5, wherein, during detecting the initiation of the transitional phase:

an average (M), for the analysis time window, of the values (C) of the load exerted on the hook (8) is determined; and at the end of a waiting period after the analysis time window, the value of the load exerted on the hook is determined;

wherein the initiation of the transitional phase is detected, during the detecting the initiation of the transitional phase, only if the difference between the value (C) of the load exerted on the hook at the end of the waiting period and the average, for the analysis time window, of the exerted load values (C), is less than or equal to an oscillation threshold.

7. The method according to claim 2, wherein, during the detecting the initiation of the transitional phase, the initiation of the transitional phase is detected only if an initial value (Ci) of the load exerted on the hook is less than or equal to a load threshold, said initial value (Ci) being set at the moment when the derivative (DERIV.CH) of the value (C) of the load exerted on the hook with respect to time is detected as being greater than or equal to the variation threshold (S1).

8. The method according to claim 1, wherein the emitting a detection signal of a proscribed lifting situation automatically starts a step of cutting the lifting movement of the load.

9. The method according to claim 1, wherein said method is implemented in a tower crane.

10. A security module for securing a lifting movement of a load mechanically coupled to a hook of a lifting device by flexible links, wherein the flexible links, when the load is placed on the ground, are either in a stretched state or in a relaxed state, the security module comprising:

means for detecting the initiation of a transitional phase between an initial instant when the load is placed on the ground and a final instant when the load is suspended in the air; and means for emitting a detection signal of a proscribed lifting situation, if the flexible links are, at least at one instant of the transitional phase, in the relaxed state.

11. The security module according to claim 10, wherein the means for emitting a detection signal of a proscribed lifting situation are configured to determine whether the flexible links are in the relaxed state by:

determining a value (C) of the load exerted on the hook;

determining the derivative (DERIV.CH) of the value (C) of the load exerted on the hook with respect to time; and identifying that the flexible links are in the relaxed state if the derivative (DERIV.CH) of the value (C) of the load exerted on the hook with respect to time is greater than or equal to a variation threshold (S1).

12. A lifting device including a security module according to claim 10.

13. The lifting device according to claim 12, wherein the lifting device is a tower crane.

* * * * *